US005564375A

United States Patent [19]

Orzal

[11] Patent Number: 5,564,375

[45] Date of Patent: Oct. 15, 1996

[54] START CIRCUIT WITH ANTI-RESTART CIRCUITRY

[75] Inventor: Gregory J. Orzal, Hartford, Wis.

[73] Assignee: Wacker Corporation, Menomonee Falls, Wis.

[21] Appl. No.: 440,833

[22] Filed: May 15, 1995

[51] Int. Cl.[6] ..... F02N 11/08

[52] U.S. Cl. ..... 123/179.3; 290/38 R

[58] Field of Search ..... 123/179.3, 179.2, 123/179.4; 290/38 R, 38 C, 38 D, 38 E, 37 A

[56] References Cited

U.S. PATENT DOCUMENTS

| | | | |
|---|---|---|---|
| 3,543,039 | 11/1970 | Mosier | 123/179.3 |
| 3,783,301 | 1/1974 | Nieukirk | 290/38 R |
| 4,570,583 | 2/1986 | Hamano et al. | 477/99 |
| 4,622,930 | 11/1986 | Hamano et al. | 477/99 |
| 4,907,562 | 3/1990 | Johansson et al. | 123/605 |
| 4,930,466 | 6/1990 | Osborne, Jr. | 123/179.5 |
| 4,951,620 | 8/1990 | Staerzl | 123/179.5 |
| 4,984,543 | 1/1991 | Tharman | 123/179.1 |
| 4,986,228 | 1/1991 | Tharman | 123/179.16 |
| 5,190,019 | 3/1993 | Harvey | 123/630 |
| 5,195,476 | 3/1993 | Schwarz | 123/179.5 |

*Primary Examiner*—Andrew M. Dolinar
*Attorney, Agent, or Firm*—Nilles & Nilles, S.C.

[57] ABSTRACT

A start circuit including: a current source; a start switch connected to the current source; a starter relay connected to the start switch; an anti-restart module connected to the starter relay, the anti-restart module including: a bi-directional thyristor having a gate, a first terminal connected to the starter relay and a second terminal connected to a ground; and a diode having a cathode and an anode, the anode being connected to the gate so as to allow current flow from the gate through the anode to the cathode; and a normally closed switch connected between the cathode and the ground, the normally closed switch becoming open upon detecting an engine run condition. The bi-directional thyristor A) is conductive when a) the cathode is connected to the ground through the normally closed switch and b) the start switch is closed so that the current source is electrically connected to the first terminal through i) the start switch and ii) the starter relay and B) latches when a) the start switch is closed and b) a current flows between the first terminal and the second terminal so that the current continues to flow through the bi-directional thyristor when the normally closed switch opens until the starter switch is opened.

20 Claims, 2 Drawing Sheets

START CIRCUIT WITH ANTI-RESTART CIRCUITRY

BACKGROUND OF THE INVENTION

1. Field of the Invention

The present invention relates generally to the field of starters for machinery. More particularly, the present invention concerns start circuits that prevent re-engagement of a starter while the machine is running. Specifically, a preferred embodiment of the present invention is directed to push button starters that include a latching anti-restart circuitry. The present invention thus relates to a start circuits of the type that can be termed latching.

2. Discussion of the Related Art

Heretofore, it was known in the prior art to employ an automotive starter switch which allows a one shot start function. A conventional automotive starter switch typically requires that the switch be cycled back through the off position to re-enable the start function. Previously recognized problems with these types of automotive starter switches are that such switches are unreliable and easily broken. Further, automotive starter key switches are impossible to seal. As with any key type switch, water can enter through the key opening. Water ingression can lead to corrosion of the terminals and subsequent malfunction. Furthermore, automotive starter switches are not fool-proof and can be easily tricked. For example by quickly turning the switch off, and then on again, the start function can be re-enabled even though the engine is still running. What is needed therefore is a starter with an anti-restart feature that is reliable and mechanically robust. Such a switch should be capable of being sealed against water. Additionally, the anti-restart feature of such a switch should not be avoidable through manual manipulation. Heretofore these requirements have not been fully met without incurring various disadvantages.

One previously recognized solution to the problem of providing a reliable sealed unavoidable switch was to use a timer that prevents re-engagement of a push button for 10–15 seconds after the button is released. A disadvantage of this previously recognized solution is that it does not prevent re-engagement while the engine is running so long as the required period has elapsed. This previous solution was not a closed loop system.

The below-referenced U.S. patents disclose embodiments that were at least inpart satisfactory for the purposes for which they were intended but which had certain disadvantages. The disclosures of all the below-referenced prior United States patents in their entireties are hereby expressly incorporated by reference into the present application for purposes including, but not limited to, indicating the background of the present invention and illustrating the state of the art.

U.S. Pat. No. 4,570,583 discloses an engine starter protecting device. An electromagnetic switch which controls the starter motor is opened as soon as the output from a series of detectors departs from a predetermined status.

U.S. Pat. No. 4,907,562 discloses a method for achieving an elevated charge of an ignition capacitor in a capacitive type ignition system. Recharging of a capacitor is delayed until the position of the crankshaft corresponds to the lowest voltage drop in the electrical system.

U.S. Pat. No. 5,195,476 discloses a method and apparatus for preventing wear in an internal combustion engine. A delay element prevents actuation of one or both of the fuel pump and the spark plug for a predetermined time interval or until pressure at the oil pump reaches a predetermined level.

SUMMARY OF THE INVENTION

The invention relates to a push button start circuit with anti-restart circuitry and is designed to prevent a starter from being engaged while an engine is running without interfering with normal starter operation. Specifically, the circuit permits starter engagement upon initial depression of the push button and permits the starter to remain engaged so long as the push button is depressed. Thereafter, engagement of the starter upon subsequent push button depression is prevented so long as the engine is running as detected by, for example, an existing oil pressure light switch. A triac has been found to be especially useful for use with the invention because it is simple and inexpensive, draws very low current, provides the desired starter latch function and yet is fool-proof and watertight.

It is therefore an object of the invention to provide a push button start that is reliable, thereby decreasing down time and operating costs.

Another object of the invention is to provide a push button starter that can be sealed against the surrounding environment.

Yet another object of the invention is to provide a push button starter that can not be overridden by rapid manipulation of a switch.

Still another object of the invention is to provide a push button starter that has one or more of the characteristics discussed above but which is relatively simple to manufacture and assemble.

In accordance with a first aspect of the invention, these objects are achieved by providing a start circuit comprising: a current source; a start switch connected to said current source; a starter relay connected to said start switch; an anti-restart module connected to said starter relay, said anti-restart module including: a bi-directional thyristor having a gate, a first terminal connected to said starter relay and a second terminal connected to a ground; and a diode having a cathode and an anode, said anode being connected to said gate so as to allow current flow from said gate through said anode to said cathode: and a normally closed switch connected between said cathode and said ground, said normally closed switch becoming open upon detecting an engine run condition, wherein said bi-directional thyristor A) is conductive when a) said cathode is connected to said ground through said normally closed switch and b) said start switch is closed so that said current source is electrically connected to said first terminal through i) said start switch and ii) said starter relay and B) latches when a) said start switch is closed and b) a current flows between said first terminal a) said second terminal so that said current continues to flow through said bi-directional thyristor when said normally closed switch opens until said starter switch is opened.

Preferably, said bi-directional thyristor is a triac and the start circuit further comprises a normally off indicator connected between said cathode and said potential and a connector between i) said starter relay and said first terminal, ii) said normally off indicator and said cathode and iii) said second terminal and said ground.

Still another object of the invention is to provide a method of starting an engine that is reliable and cannot be overridden by rapid manipulation of a start switch.

In accordance with another aspect of the invention, this object is achieved by providing a method of preventing a relay from switching comprising: providing the start circuit discussed above: closing said start switch so as to cause said current to flow through said start switch, said starter relay, said bi-directional thyristor and said normally closed switch so that said current is latched in said anti-restart module until said start switch is opened; and opening said start switch so that said current is interrupted, wherein reclosing said start switch will not cause current to flow through said starter relay. Preferably, closing said start switch includes pushing a push button switch.

An effect of the present invention is to prevent engagement of a starter motor with an engine that is already running. Other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by retorting to the exemplary, and therefore non-limiting, embodiments illustrated in the drawings accompanying and forming a part of this specification, wherein like reference numerals designate,the same elements in the several views and in which.

DESCRIPTION OF PREFERRED EMBODIMENTS

Figure 1:
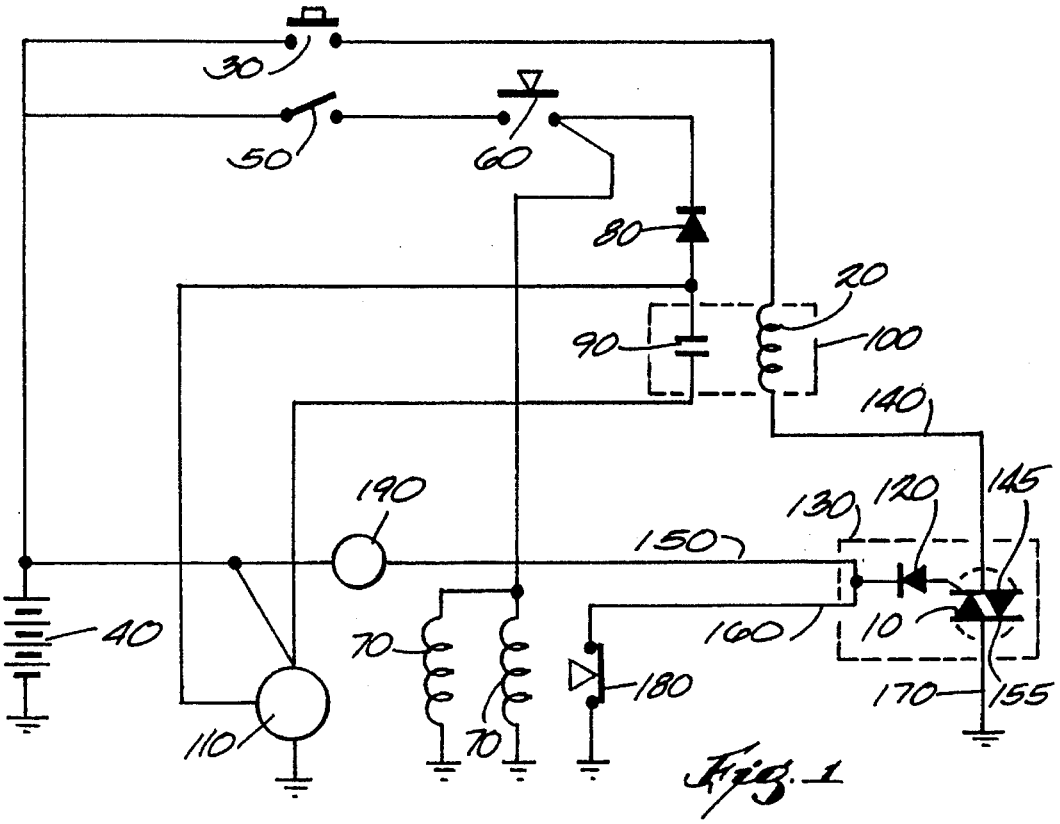
FIG. 1 illustrates a schematic view of a circuit according to the present invention.

The present invention and various features and advantageous details thereof are explained more fully with reference to exemplary, and therefore non-limiting, embodiments described in detail in the following disclosure and with the aid of the drawings.

1. SYSTEM OVERVIEW

A push button switch is combined with an engine oil pressure switch or some other device that is indicative of engine operation. When the push button switch is actuated a bi-directional thyristor is latched. The benefit of latching is that once current begins to flow through the bi-directional thyristor, it will continue to flow until the push button switch is opened. As soon as the push button switch is opened, re-engagement is prevented as long as the engine oil pressure switch is opened. A diode prevents an oil pressure light from being energized when the pressure switch is opened. Re-engagement can be prevented for several seconds after the system stops because the oil pressure switch does not open until several seconds after the engine stops.

2. DETAILED DESCRIPTION OF PREFERRED EMBODIMENTS

The above-mentioned requirements are mutually contradicting and cannot be satisfied simultaneously in the case of prior art techniques. However, it is rendered possible to simultaneously satisfy these requirements to a certain extent by employing an anti-restart circuit having a bi-directional thyristor in consideration of the fact that the bi-directional thyristor can provide current latching features.

Referring to the drawings, it can be seen that the design is simple and rugged. Pursuant to the present invention, the push button starter is attached to the ignition system of a vehicle.

Referring to FIG. 1, one anode of bi-directional thyristor 10 is connected to ground. The other anode of bi-directional thyristor 10 is connected to relay solenoid 20. Relay solenoid 20 is also connected to push button switch 30. Push button switch 30 is also connected to a source of direct current power, in this case battery 40. Engine run switch 50 is connected in parallel with push button switch 30. Engine run switch 50 is connected in series with fuel valve 70.

Relay solenoid 20 and relay switch 90 together compose starter relay 100. When a current flows through relay solenoid 20, relay switch 90 is closed, thereby permitting starter 100 to crank an internal combustion engine. In order for a current to flow through relay solenoid 20, the gate of bi-directional thyristor 10 must be grounded. The gate of bi-directional thyristor 10 is connected to gate diode 120. Bi-directional thyristor 10 and gate diode 120 together compose anti-restart module 130.

There are tour electrical conductors attaching anti-restart module 130 to the rest of the ignition system. High lead 140 connects a high anode 145 of bi-directional thyristor 10 to relay solenoid 20. Low lead 170 connects a low anode 155 of bi-directional thyristor 10 to ground. Pressure indicator lead 150 connects gate diode 120 to engine oil pressure light 190. Pressure switch lead 160 is connected in parallel with pressure indicator lead 150 and connects gate diode 120 to normally closed engine oil pressure switch 180.

Prior to engine rotation, the normally closed engine oil pressure switch 180 sensing zero engine oil pressure is used to ground the gate of bi-directional thyristor 10. The bi-directional thyristor 10 will conduct electricity across high anode 145 and low anode 155 when the gate is grounded.

Engine rotation is initiated by first enabling the electrical circuit by means of the engine run switch 50 and then pressing push button switch 30. Approximately 150 mA of electrical current will flow through the push button switch 30, high anode 145 and low anode 155 of hi-directional thyristor 10 and relay solenoid 20. Relay switch 90 of starter relay 100 will shift and allow full battery potential to the starter 110.

Once the engine starts to rotate, the oil pressure will build, and the normally closed engine oil pressure switch 180 will open. Due to the 150 mA of current flow through the bi-directional thyristor 10, the bi-directional thyristor 10 will remain latched even when the ground connection to the gate is opened. The starter 110 will remain engaged until either the push button switch 30 is released or the engine is switched off. Once the push button switch 30 is released, the bi-directional thyristor prevents the starter 110 from becoming re-engaged, should push button switch 30 be re-press, as long as the ground connection to the gate remains open.

In a preferred embodiment, bi-directional thyristor 10 is a triac. An especially preferred triac is available from Tech-Cor Electronics of Irving, Tex. under the model number designation Q6008RS. This particular model is a non-insulated, gated triac rated at 600 volts and 8 amps. An alternative embodiment uses an altranistor in place of the triac. Although the inherent design of the altranistor is less flexible than the triac because the gate of an altranistor must be low for current to flow across the anodes, no disadvantage in using an altranistor for the present invention is realized because the gate is normally grounded. The gate diode 120 is necessary to prevent the engine oil pressure indicator 190 from being energized when the normally closed engine oil pressure switch 180 is opened. It will be appreciated that the normally closed engine oil pressure switch 180 does not close until several seconds after the engine stops. This several second delay provides the time delay feature that is provided by prior art devices.

Figure 2:
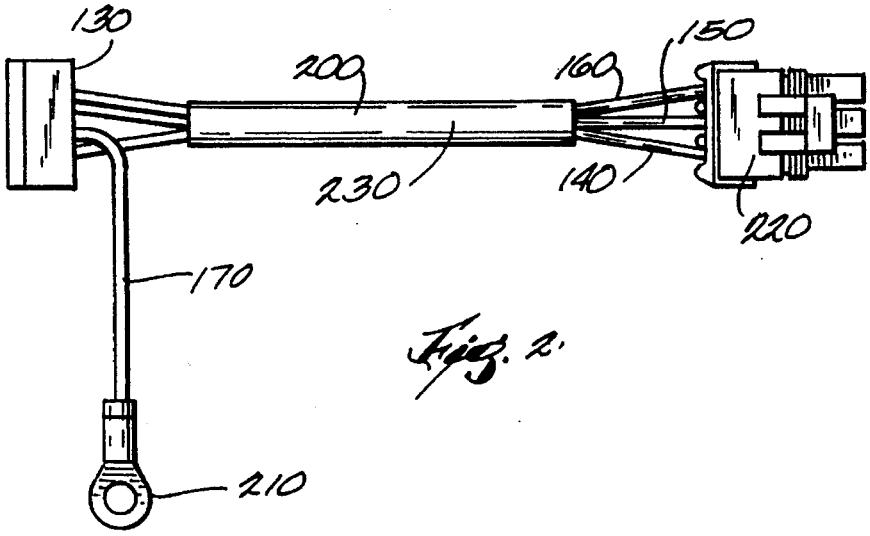
FIG. 2 illustrates an elevational view of an anti-restart module with wiring according to the present invention.

Referring to FIG. 2, anti-restart module 130 can be seen at one end of a wiring harness 200. Low lead 170 connects the anti-restart module 130 to ground tab 210. High lead 140, pressure indicator lead 150, and pressure switch lead 160 connect anti-restart module 130 to connector 220. In a preferred embodiment, wrap tubing 230 surrounds at least a portion of each of high lead 140, pressure indicator lead 150 and pressure switch lead 160. Although the preferred embodiment shown in FIG. 2 depicts the invention in the form of wiring harness 200, it is within the level of ordinary skill in the art after having knowledge of the invention disclosed herein to figure the components in any manner that permits the device to function for its intended purpose.

The disclosed embodiment shows a normally closed engine oil pressure switch 180 for preforming the function of disconnecting the low anode to ground while the engine is operating, but the structure for disconnecting the low anode to ground can be any other structure capable of performing the function of presenting an open circuit only during engine operation, including, by way of example, a vacuum gauge, a tachometer or an alternator gauge.

Conveniently, the wiring harness of the present invention can be made of any conductive and nonconductive materials. For the manufacturing operation, it is moreover an advantage to employ copper alloy for the conductors and high density polyethylene for the insulator materials.

Conveniently, the harness of the present invention can be assembled using any method. For the manufacturing operation, it is moreover an advantage to employ potting compound to encase the bi-directional thyristor 10 in a potting box having mounting holes.

Figure 3:
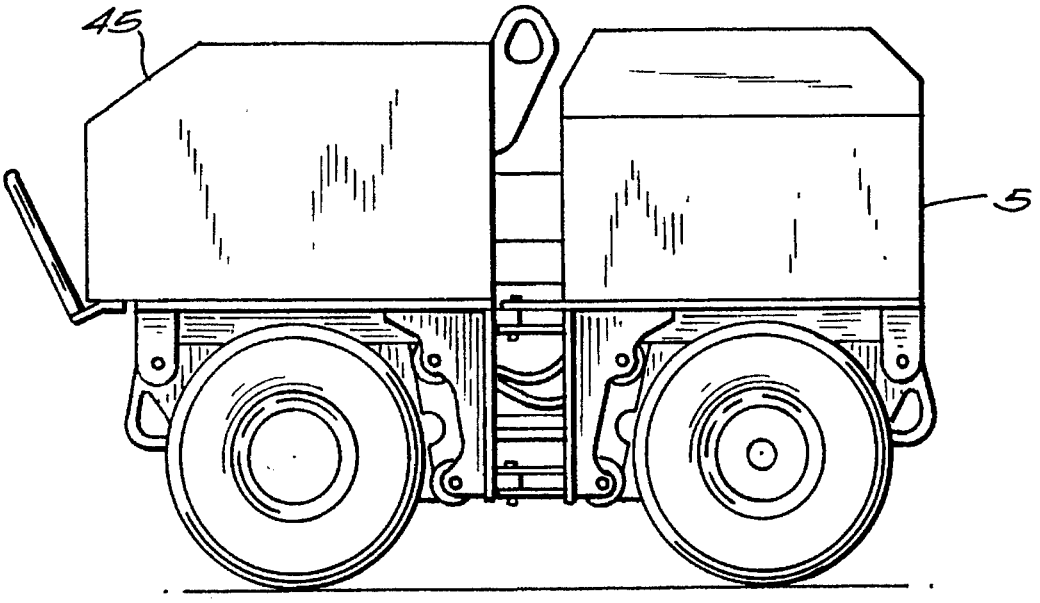
FIG. 3 illustrates an elevational view of a vehicle containing a start circuit according to the present invention.

Referring to FIG. 3, the vehicle 5 is shown from the side. Although the particular embodiment depicted in this figure is an articulated trench compactor, vehicle 5 can be any type of automobile, boat or aircraft. Vehicle 5 includes control panel 45. The start circuit according to the present invention can be located behind control panel 45 or, alternatively, anywhere within vehicle 5.

Figure 4:
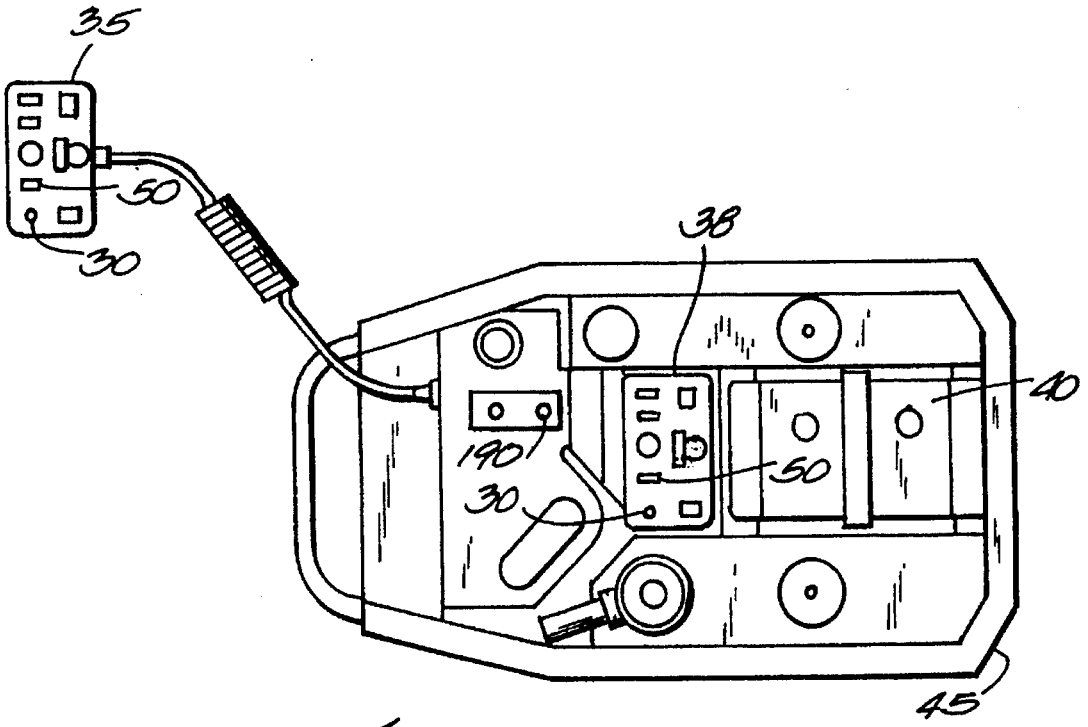
FIG. 4 illustrates an plan view of a control panel that includes a start circuit according to the present invention.

Referring now to FIG. 4, battery 40 is located at the surface of control panel 45. Similarly, engine oil pressure indicator 190 is located at the surface of control panel 45. Control panel 45 is connected to cable-operated control box 35 with a cable. However, such a control box can be located at the surface of control panel 45. Cable-operated control box 35 includes push button switch 30 and engine run switch 50. In addition, control panel 45 can be operated by infra-red remote control transmitter 38. Infra-red remote control transmitter 38 is depicted as being placed against the surface of control panel 45. However, infra-red remote control transmitter 38 can be used to operate control panel 45 from a remote location. Infra-red remote control transmitter 38 includes push button switch 30 and engine run switch 50.

Although the best mode contemplated by the applicant of carrying out the present invention is disclosed above, practice of the present invention is not limited thereto. Numerous changes in the details of the parts, the arrangement of the parts and the construction of the subcombinations will be readily apparent to one of ordinary skill in the art without departing from the spirit and scope of the underlying inventive concept. For example, the anti-restart feature could be enhanced by providing more than one engine run detector. In addition, although a normally closed engine oil switch is preferred for detecting the engine run condition, any other suitable detector could be used in its place. Finally, the individual components need not be constructed of the disclosed materials or be formed in the disclosed shapes, but could be provided in virtually any configuration which employs a latching circuit so as to provide an anti-restart capability.

Moreover, while there are shown and described herein certain specific combinations embodying the present invention for the purpose of clarity of understanding, practice of the present invention is not limited thereto. All the disclosed features of each disclosed embodiment can be combined with, or substituted for, the disclosed features of every other disclosed embodiment except where such features are mutually exclusive. It will be manifest to those of ordinary skill in the art that various additions, modifications and rearrangements of the features of the present invention may be made without deviating from the spirit and scope of the underlying inventive concept.

It is intended that the appended claims cover all such additions, modifications and rearrangements. Expedient embodiments of the present invention are differentiated by the appended subclaims.

What is claimed is:

1. A start circuit comprising:

a current source;

a start switch connected to said current source;

a starter relay connected to said start switch;

an anti-restart module connected to said starter relay, said anti-restart module including:

a bi-directional thyristor having a gate, a first terminal connected to said starter relay and a second terminal connected to a ground; and a diode having a cathode and an anode, said anode being connected to said gate so as to allow current flow from said gate through said anode to said cathode; and a normally closed switch connected between said cathode and said ground, said normally closed switch becoming open upon detecting an engine run condition, wherein said bi-directional thyristor A) is conductive when a) said cathode is connected to said ground through said normally closed switch and b) said start switch is closed so that said current source is electrically connected to said first terminal through i) said start switch and ii) said starter relay and B) latches when a) said start switch is closed and b) a current flows between said first terminal and said second terminal so that said current continues to flow through said bi-directional thyristor when said normally closed switch opens until said starter switch is opened.

2. The start circuit of claim 1, wherein said start switch is a push button switch.

3. The start circuit of claim 1, wherein said bi-directional thyristor is one member selected from the group consisting of a triac and an altranistor.

4. The start circuit of claim 1, wherein said normally closed switch is one member selected from the group consisting of a normally closed engine oil pressure switch, a normally closed vacuum switch and a normally closed alternator current switch.

5. The start circuit of claim 1, further comprising a normally off indicator connected between said cathode and said potential.

6. The start circuit of claim 5, further comprising a connector between i) said starter relay and said first terminal, ii) said normally off indicator and said cathode and iii) said second terminal and said ground.

7. A method of preventing a relay from switching comprising:

providing a start circuit including:

a current source;

a start switch connected to said current source;

a starter relay connected to said start switch;

an anti-restart module connected to said starter relay, said anti-restart module including:

a bi-directional thyristor having a gate, a first terminal connected to said starter relay and a second terminal connected to a ground; and a diode having a cathode and an anode, said anode being connected to said gate so as to allow current flow from said gate through said anode to said cathode; and a normally closed switch connected between said cathode and said ground, said normally closed switch becoming open upon detecting an engine run condition, wherein said bi-directional thyristor A) is conductive when a) said cathode is connected to said ground through said normally closed switch and b) said start switch is closed so that said current source is electrically connected to said first terminal through i) said start switch and ii) said starter relay and B) latches when a) said start switch is closed and b) a current flows between said first terminal and said second terminal so that said current continues to flow through said bi-directional thyristor when said normally closed switch opens until said starter switch is opened;

closing said start switch so as to cause said current to flow through said start switch, said starter relay, said bi-directional thyristor and said normally closed switch so that said current is latched in said anti-restart module until said start switch is opened; and opening said start switch so that said current is interrupted, wherein reclosing said start switch will not cause current to flow through said starter relay.

8. The method of claim 7, where closing said start switch includes pushing a push button switch.

9. In a control panel, the improvement comprising a start circuit including:

a current source;

a start switch connected to said current source;

a starter relay connected to said start switch;

an anti-restart module connected to said starter relay, said anti-restart module including:

a bi-directional thyristor having a gate, a first terminal connected to said starter relay and a second terminal connected to a ground; and a diode having a cathode and an anode, said anode being connected to said gate so as to allow current flow from said gate through said anode to said cathode; and a normally closed switch connected between said cathode and said ground, said normally closed switch becoming open upon detecting an engine run condition, wherein said bi-directional thyristor A) is conductive when a) said cathode is connected to said ground through said normally closed switch and b) said start switch is closed so that said current source is electrically connected to said first terminal through i) said start switch and ii) said starter relay and B) latches when a) said start switch is closed and b) a current flows between said first terminal and said second terminal so that said current continues to flow through said bi-directional thyristor when said normally closed switch opens until said starter switch is opened.

10. The control panel of claim 9, wherein said start switch is a push button switch.

11. The control panel of claim 9, wherein said bi-directional thyristor is one member selected from the group consisting of a triac and an altranistor.

12. The control panel of claim 9, wherein said normally closed switch is one member selected from the group consisting of a normally closed engine oil pressure switch, a normally closed vacuum switch and a normally closed alternator current switch.

13. The control panel of claim 9, further comprising a normally off indicator connected between said cathode and said potential.

14. The control panel of claim 13, further comprising a connector between i) said starter relay and said first terminal, ii) said normally off indicator and said cathode and iii) said second terminal and said ground.

15. In a vehicle, the improvement comprising a start circuit including:

a current source;

a start switch connected to said current source;

a starter relay connected to said start switch;

an anti-restart module connected to said starter relay, said anti-restart module including:

a bi-directional thyristor having a gate, a first terminal connected to said starter relay and a second terminal connected to a ground; and a diode having a cathode and an anode, said anode being connected to said gate so as to allow current flow from said gate through said anode to said cathode; and a normally closed switch connected between said cathode and said ground, said normally closed switch becoming open upon detecting an engine run condition, wherein said bi-directional thyristor A) is conductive when a) said cathode is connected to said ground through said normally closed switch and b) said start switch is closed so that said current source is electrically connected to said first terminal through i) said start switch and ii) said starter relay and B) latches when a) said start switch is closed and b) a current flows between said first terminal and said second terminal so that said current continues to flow through said bi-directional thyristor when said normally closed switch opens until said starter switch is opened.

16. The vehicle of claim 15, wherein said start switch is a push button switch.

17. The vehicle of claim 15, wherein said bi-directional thyristor is one member selected from the group consisting of a triac and an altranistor.

18. The vehicle of claim 15, wherein said normally closed switch is one member selected from the group consisting of a normally closed engine oil pressure switch, a normally closed vacuum switch and a normally closed alternator current switch.

19. The vehicle of claim 15, further comprising a normally off indicator connected between said cathode and said potential.

20. The vehicle of claim 19, further comprising a connector between i) said starter relay and said first terminal, ii) said normally off indicator and said cathode and iii) said second terminal and said ground.

* * * * *